US006244662B1

(12) United States Patent
Porcheron

(10) Patent No.: US 6,244,662 B1
(45) **Date of Patent: *Jun. 12, 2001**

(54) ELEVATOR CHAIR OF ADJUSTABLE SEAT DEPTH

(75) Inventor: François Porcheron, Lyons (FR)

(73) Assignee: I.D.C. Medical, Beynost Cedex (FR)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/283,745

(22) Filed: Apr. 2, 1999

(51) Int. Cl.[7] ..... A61G 5/14

(52) U.S. Cl. ..... 297/383; 297/DIG. 4; 297/DIG. 10; 5/86.1

(58) Field of Search ..... 297/383, DIG. 4, 297/DIG. 10; 5/86.1, 618, 83.1; 280/250.1

(56) References Cited

U.S. PATENT DOCUMENTS 4,966,379 * 10/1990 Mulholland ..... 280/250.1

5,346,280 * 9/1994 Deumite ..... 297/DIG. 10

* cited by examiner

*Primary Examiner*—Alexander Grosz

(74) *Attorney, Agent, or Firm*—Dennison, Scheiner, Schultz & Wakeman

(57) ABSTRACT

A wheelchair including a chassis (2) and an articulated height adjustment structure (12) with a seat, foot rest and back is disclosed. The articulated structure is made up of two symmetrical and lateral articulated systems, each having a first folding quadrilateral (17) with upper and lower bars (18, 19), pivoted at the front to the chassis and at the back by a spacer (20), and a second folding quadrilateral which helps to support the foot rest and connects the chassis at the front to the first quadrilateral. Each spacer is in the form of a triangular plate connected to the upper and lower bars (18, 19) by fixing nuts which can be set in adjustable positions on the bars. The spacers on opposite sides of the wheelchair are connected by a crosspiece.

10 Claims, 3 Drawing Sheets

ELEVATOR CHAIR OF ADJUSTABLE SEAT DEPTH

The present invention relates to chairs, generally but not exclusively wheel-chairs, for use by the handicapped and by invalids, and it is equally applicable to folding wheel-chairs and to non-folding wheel-chairs.

BACKGROUND OF THE INVENTION

There is no doubt that wheel-chairs have given mobility to the handicapped and to invalids. Nevertheless, such wheel-chairs suffer from various drawbacks due to the fact that their users can occupy a sitting position only, which position is also generally maintained for relatively long periods of time.

Such a position is unsuitable for providing readaptation to ordinary life and it does not facilitate social contacts. In addition, when a sitting position is maintained for relatively long periods of time, it causes physical deterioration, such as the loss of angular amplitude in the lower limbs, defective blood circulation, slowing down of the digestive and intestinal functions, bone fragility, etc.

To remedy the above drawbacks, proposals have been made for chairs each having a chassis that supports a hinged structure comprising a seat back, a seat, and a footrest. Such a structure is mounted in hinged relationship to the seat on a front horizontal axis, extending perpendicularly to the vertical plane of symmetry of the chassis. The hinged structure can be controlled with full motorization or with motorization for power assistance to cause the seat to pass from a low position to a high position, and vice versa. Such chairs are often referred to as "verticalizing chairs".

Regardless of whether the source of power that controls raising and lowering of the hinged structure or that enables it to be controlled is based on electricity, or on elastic actuators, in particular gas actuators, or is purely manual, chairs of the above type have certainly made it possible to a large extent to solve the drawbacks that stem from using a conventional chair.

That is doubtless why such chairs have been such a success over several years. By way of reference, mention can be made of French patent FR 2 529 456 which specifically relates to a design for such a verticalizing chair.

Although they give satisfaction, it appears that such chairs give rise to objections concerning comfort relating in particular to the nature of the hinged structure for raising and lowering the invalid or handicapped person in a position of maximum safety.

Account needs to be taken of the hinged nature of the structure which is capable of passing from a traditional seated position to an elevated or verticalizing position in which the various segments making up the structure are substantially in alignment one after another, in a pseudo-vertical direction.

To satisfy anatomical requirements in the various positions it can occupy, the hinged structure is made up of a seat element, a back element, and a footrest element which must therefore be capable of occupying a relative position that is generally of the seat type, and also of being placed in line with one another in the verticalization position.

Substantially parallel relative hinge planes are therefore necessarily established which are situated between the seat and the footrest, and between the seat and the back.

Although these various hinged segments do not give rise to major problems of comfort in supporting and holding the body of a handicapped subject or an invalid when they are in the traditional seated position, on passing into the verticalized position these various segments are generally subjected to displacement in which they slide relative to the body of the subject. This relative displacement is not good for maintaining maximum comfort, and in particular it requires appropriate settling back into the chair when in the seated position, so that the subject is again bearing comfortably against the back, against the seat, and against the footrest.

On reflection, it appears that this problem which, even if it is secondary, needs nevertheless to be addressed, stems from the fact that the hinged structures fitted to chairs for verticalizing purposes provide no scope for adjusting the depth of the seat as a function of the morphology of the subject.

Thus, apart from the ideal case where the depth of the seat is right, it can be considered that as a general rule this depth is either too deep or not deep enough to provide the subject with maximum comfort, whether in the sitting position or in the verticalization position.

OBJECTS AND SUMMARY OF THE INVENTION

The object of the invention is to propose improvements to known elevator chairs suitable for providing the option of adjusting the depth of the seat so as to make it easier to achieve personalized matching to the morphology of each subject, thereby contributing to providing the benefit of improved comfort.

To achieve the above objects, the invention provides an elevator chair for the handicapped and for invalids, the chair being of the type comprising a chassis supporting a hinged structure comprising a seat, a footrest, and a back, such a structure being made up of two lateral symmetrical hinged systems, each comprising:

a first deformable quadrilateral contributing to supporting the seat, made up of a top bar and a bottom bar, hinged to the front portion of the chassis and linked towards their rear portions by a spacer piece;

a second deformable quadrilateral contributing to supporting the footrest and linking the chassis to the front portion of the first deformable quadrilateral;

a back frame hinged to the first quadrilateral at its end remote from the second quadrilateral via a triangle formed in part by the spacer piece; and a drive assembly interposed between the first quadrilateral and the chassis and serving to control relative pivoting of the lateral system from a low position to an elevated position of the structure relative to the chassis, and vice versa.

In the chair, the spacer piece is mounted on the top and bottom bars by means of fixing pieces whose positions on said bars are adjustable relative to the front portion of the chassis.

BRIEF DESCRIPTION OF THE DRAWINGS

Various other characteristics appear from the following description given with reference to the accompanying drawings which show embodiments of the invention as non-limiting examples.

MORE DETAILED DESCRIPTION

Figure 1:
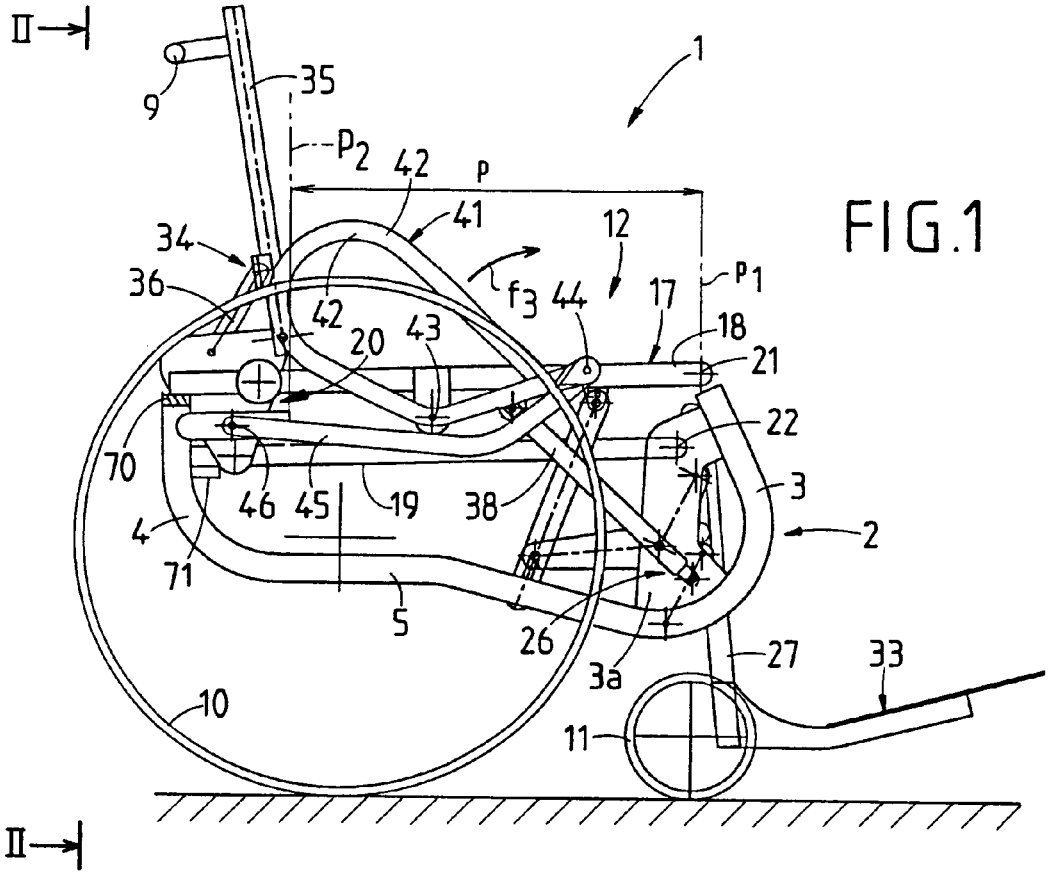
FIG. 1 is a diagrammatic side elevation of an elevator chair of the wheel-chair type.
Figure 2:
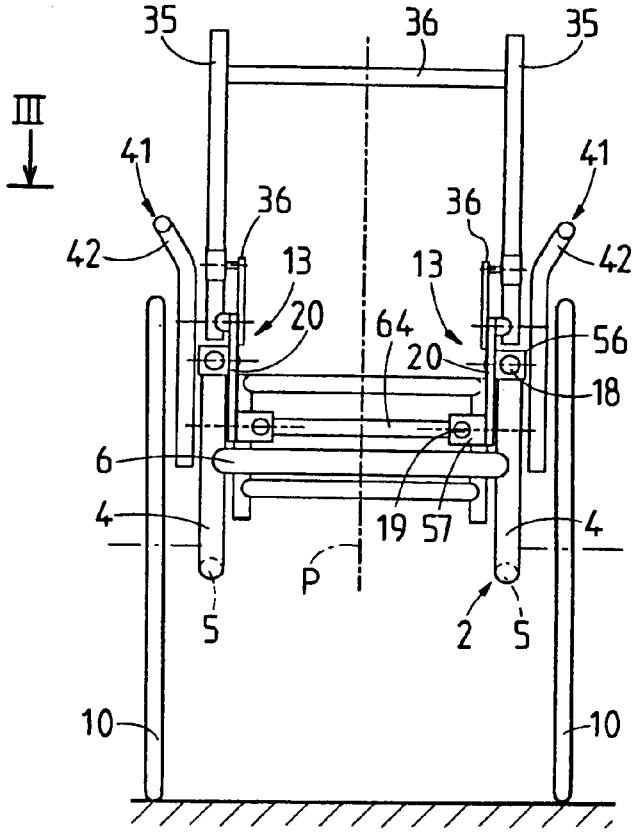
FIG. 2 is a rear view on line II—II of FIG. 1.
Figure 3:
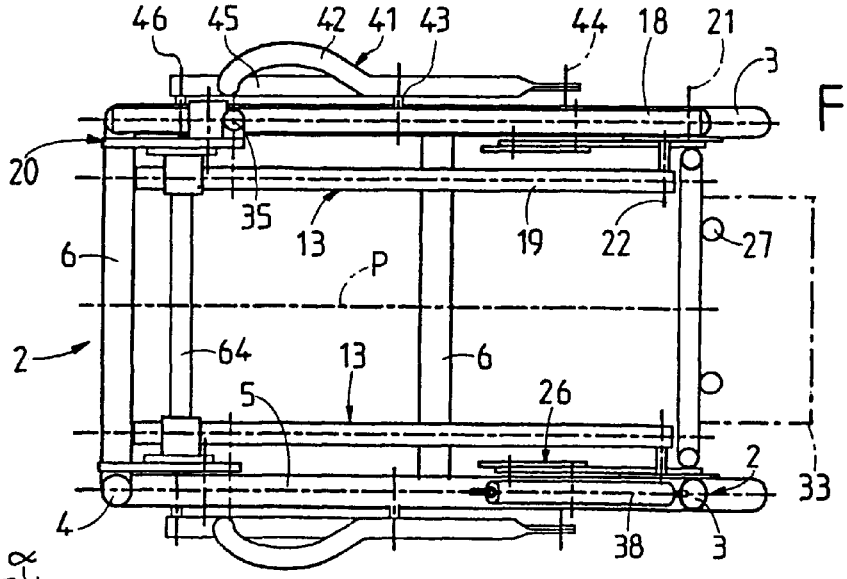
FIG. 3 is a plan view on line III—III of FIG. 2.

FIGS. 1, 2, and 3 are diagrams showing an elevator chair 1 of the wheel-chair type. Such a chair comprises a chassis 2 made up of front uprights 3 and back uprights 4 interconnected by length members 5 and by cross-members 6. These various component elements define a load-carrying frame that is provided with driving wheels 10 and with steerable swivel wheels 11.

As shown, the chassis 2 corresponds to a chair of rigid design, but naturally a substantially analogous configuration could be obtained with a folding chair. Under such circumstances, the rigid cross-members 6 would need to be replaced by folding elements of conventional design.

The above-described chassis 2 is fitted with an elevator device which is made in the form of a hinged structure 12 carried by the chassis 2. The hinged structure 12 is constituted by two lateral hinged systems that are symmetrical about a sagittal plane P and which can be seen more particularly in FIGS. 2 and 3. Each hinged system 13 is designed to be fitted laterally onto the chassis 2, e.g. in the vicinity of the uprights 3, 4 and of the length member 5 on each side.

Each hinged system 13 comprises a first deformable quadrilateral 17 made up of a top bar 18 and a bottom bar 19, even though they are not disposed in the same vertical plane in the embodiment shown. The bars 18 and 19 are united via their back end portions by means of a spacer piece or element 20, and they are mounted on the chassis 2 in the vicinity of the front portion thereof via a first hinge point 21 for the top bar 18 and a second hinge point 22 for the bottom bar 19. In the present case, the hinge point 21 is provided in the top portion of the upright 3, while the hinge point 22 is situated on a side plate 3*a* connecting the upright 3 to the length member 5.

In the example shown, the spacer element 20 is designed to correspond to the distance between the hinge points 21 and 22 so that the quadrilateral 17 has a privileged shape in which it constitutes a deformable parallelogram.

Each hinged system 13 also has a second deformable quadrilateral 26 connecting the first deformable quadrilateral to an upright 27 designed to support a footrest 33 either on its own or in combination with a similar upright.

Finally, each hinge system 13 has a triangle 34 linked to the rear portion of the quadrilateral 17 and carrying an upright 35 optionally provided with a handle 9. The uprights 35 corresponding to the two hinged assemblies 12 are united by a cross-member 36 to constitute a back frame, and in similar manner at least the top bars 18 are united by any appropriate means to form a seat frame.

The triangle 34 is made up of a portion of the upright 35, a triangulating strut 36, and the spacer element 20 so that for each lateral system 13 it is linked to the first deformable quadrilateral 17.

In the situation shown in FIG. 1, the depth p of the seat between the front plane $P_1$ and the back plane $P_2$ is determined by the link established between the triangle 34 and the quadrilateral 17 in each of the hinged assemblies 13.

By way of illustration, each hinged assembly 13 also has a resilient member 38, e.g. interposed between the side plate 3*a* and the top bar 18. Similarly, each hinged system 13 has a drive member 41 constituted by a loop or the like 42 hinged via a point 43 to the quadrilateral 17, and more particularly to the top bar 19, and linked by a hinge 44 to a lever 45 mounted via hinge pin 46 to the rear portion of the chassis 2.

The object of the invention is to make the depth p adjustable as a function of the morphology of the user.

Figure 4:
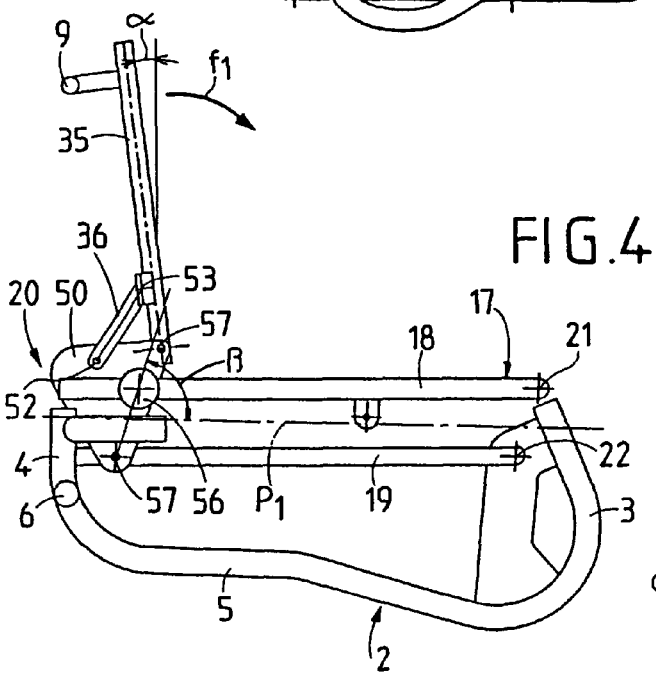
FIGS. 4 and 4A are diagrammatic elevation views showing more clearly the means of the invention.
Figure 5:
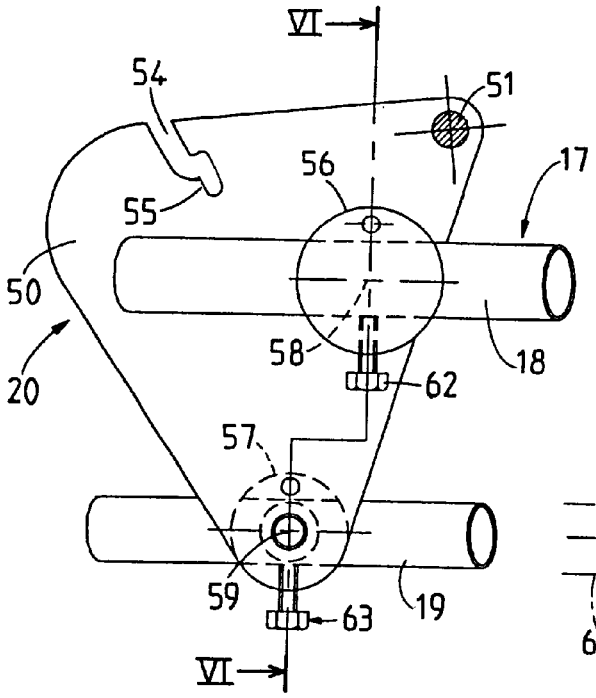
FIG. 5 is a fragmentary elevation view on a larger scale showing certain structural details of the means of the invention.
Figure 6:
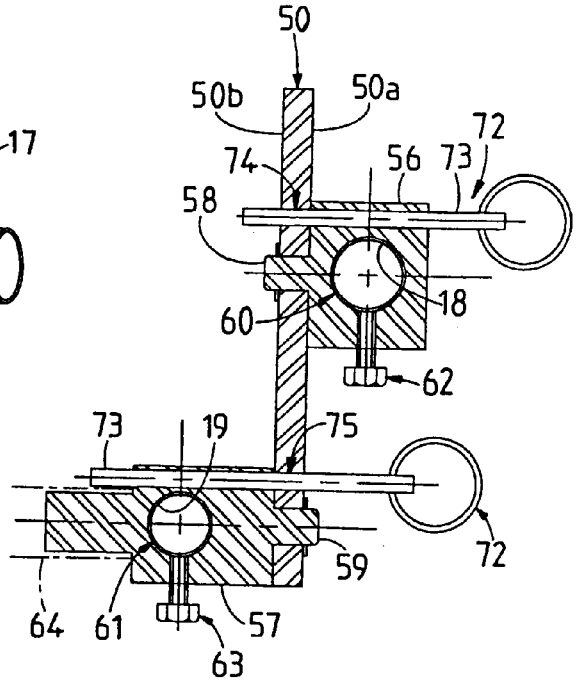
FIG. 6 is a section view on chain-dotted line VI—VI of FIG. 5.
Figure 7:
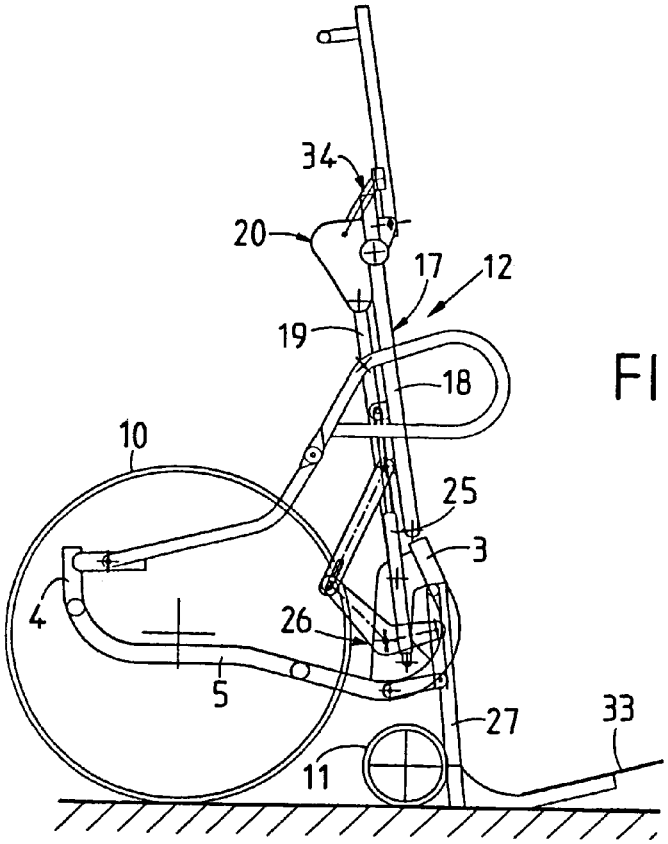
FIG. 7 is an elevation view showing another characteristic of the elevator chair of the invention.

To this end, and in accordance with the invention, each spacer piece 20, as shown more particularly in FIGS. 4 to 6, comprises a triangular plate 50 carrying via a fixing pin 51 the upright 35 and via a fixing pin 52 the triangulation strut 36 which is itself linked via a pin 53 to the upright 35. Provision is preferably made for the fixing pin 52 to be implemented in the form of a finger that is designed to co-operate with an open notch or slot 54 in the periphery of the plate 50 and which is of an angled shape so as to provide an internal abutment 55.

By the above means, the upright 35 is secured to the plate 50 from which the finger 52 can nevertheless be disengaged by overcoming the abutment 51 so as to be extracted from the notch or slot 54 to allow the relative angular position to be released, as shown in FIG. 4, thereby making it possible to change the angle of the upright 35, e.g. in the direction of arrow $f_1$, for the purpose of folding the back frame down onto the seat frame.

On each of its faces 50*a* and 50*b*, respectively referred to as the "outer" face and the "inner" face relative to the plane P, the plate 50 has respective fixing pieces 56 and 57 each mounted on a respective pivot 58 and 59 about an axis perpendicular to the plane P. Each fixing piece 56 and 57 has a respective through bore 60 or 61 of axis perpendicular to the pivot axes and suitable for snugly and slidably receiving either the upper bar 18 or the lower bar 19. Each of the fixing pieces 56 and 57 is also provided with respective clamping means 62, 63 making it possible to lock the corresponding fixing piece to the bar 18 or 19 as the case may be in any position along the length thereof. The clamping means 62 and 63 can be of various kinds in order to perform the above function. Thus, they may be lock screws, slots formed in the fixing pieces to enable them to act as clamping jaws under the control of screws, or indeed internal linings that can be moved perpendicularly to the axis of the bar by means of a pressure screw or the like. It must be considered that technical means for providing the above function form part of the knowledge of the person skilled in the art.

As can be seen in FIG. 2, and also in FIG. 6, the corresponding plates 50 in the two hinged systems 13 are preferably secured by any appropriate means to each other so as to form a unitary assembly that is adjustable in position simultaneously on both of the deformable quadrilaterals 17. The securing means used may advantageously be constituted by a cross-member 64 engaged on two stub portions 65 presented facing each other on the corresponding fixing pieces 57.

Figure 4A:
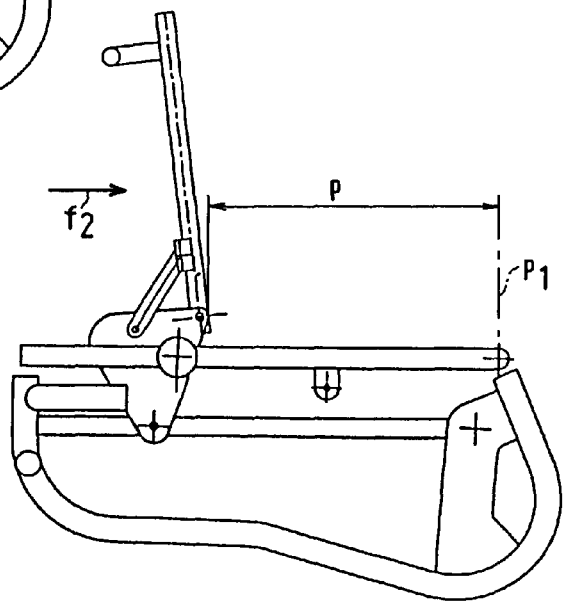

Using the above-described technical means, it is possible to adjust the depth p by loosening the means 62 and 63 so as to release the plates 50 and allow relative sliding to take place between the fixing pieces and the bars so as to move the uprights 35 towards or away from the plane $p_1$. An example is given in FIGS. 4 and 4A showing how the back frame can be moved in the direction of arrow $f_2$ towards the plane $p_1$.

Once the depth p has been obtained, it suffices to tighten the members 62 and 63 so as to lock the back frame in the required position corresponding to the morphological characteristics of the subject using the chair.

By means of the above dispositions, when the hinged structure 12 is put into the elevated position by using the control members 41, i.e. by acting on them in the direction of arrow $f_3$ (FIG. 1), the frame of the seat is caused to pivot on the axes 21 and 22, with assistance being provided by the action of the resilient members 38. While this pivoting is taking place, the two deformable quadrilaterals 17 behave, as a function of their geometrical characteristics, so as to lift the two plates 50 while maintaining them in the orientation they possessed initially in the seated position, as shown in FIG. 1.

In this way, the back frame is raised correspondingly while maintaining the specific orientation imparted thereto by the triangulation struts 34 whose length may optionally be adjustable so as to adjust the angle $\alpha$ formed between the uprights 35 and the vertical.

During the above-described movement, the pivots 58 and 59 pivot freely in each of the plates 50.

Reverse movement occurs when action is taken on the members 41 to return the hinged structure 12 from the vertical position to the sitting position.

It should be observed that the sitting position is determined, e.g. in positive manner, by the assistance of an abutment 70 carried by the top end of each of the uprights 4 to co-operate with a corresponding end portion of the top bar 18 of each quadrilateral 17.

It can be envisaged that the sitting position is determined positively by means of an abutment 71 provided between the upright 4 and the bottom bar 19 of each deformable quadrilateral 17.

On such a basis, it becomes possible to modify the angle $\beta$ formed by the line defined by the pivots 58 and 59 relative to the horizontal plane such as $P_1$, by rotating the pivots 58 and 59 relative to each of the plates 50.

In this way, it is possible to adjust the position of the seat frame relative to the plane $P_1$ by an amount that is indeed small, but that nevertheless contributes to user comfort. Additional adjustment can then be envisaged to modify the angle $\alpha$ correspondingly by varying the length of the triangulation strut 36.

FIG. 6 shows that it can be advantageous to provide each fastening piece 56 or 57 with means 72 for locking it on the pivot axis 58 or 59. Such means 72 can be constituted by a pin 73, e.g. of the elastically locking type, e.g. having a spring-loaded ball, the pin passing through the body of the fixing piece and being engaged in a through hole 74 or 75 presented in the plate 50.

In this way, it becomes possible to lock each of the fixing pieces 56 and 57 angularly on the plate 50 prior to loosening the locking members 62 and 63 prior to adjusting seat depth p.

Thus, any change to the position of each of the plates 50 relative to the plane $P_1$ gives rise to no change to the angle $\beta$, such that the deformable quadrilateral 17 of each hinged system 13 retains the geometrical characteristics that were initially imparted thereto.

It can be envisaged to replace each through hole 74 by a plurality of holes in communication, established in the form of a rack extending over a circular arc, with each hole corresponding to a particular value for the angle $\beta$.

Although not shown, it could be envisaged to make the plate 50 so as to provide the option of adjusting the distance between the axes of the bearings that receive the pivots 58 and 59. Such technical means could satisfy a possible requirement for adjusting the position of the seat frame relative to the plane $P_1$.

The invention is not limited to the examples described and shown since numerous modifications can be applied thereto without going beyond the ambit of the invention.

What is claimed is:

1. An elevator chair for the handicapped and for invalids, the chair being of the type comprising a chassis supporting a hinged structure comprising a seat, a footrest, and a back, such a structure being made up of two lateral symmetrical hinged systems, each comprising:

a first deformable quadrilateral contributing to supporting the seat, made up of a top bar and a bottom bar, hinged to the front portion of the chassis and linked towards their rear portions by a spacer piece;

a second deformable quadrilateral contributing to supporting the footrest and linking the chassis to the front portion of the first deformable quadrilateral;

a back frame hinged to the first quadrilateral at its end remote from the second quadrilateral via a triangle formed in part by the spacer piece; and a drive assembly interposed between the first quadrilateral and the chassis and serving to control relative pivoting of the lateral system from a low position to an elevated position of the structure relative to the chassis, and vice versa;

wherein the spacer piece is mounted on the top and bottom bars by means of fixing pieces whose positions on said bars are adjustable relative to the front portion of the chassis.

2. An elevator chair according to claim 1, wherein the spacer pieces of the two hinged systems are secured to each other by at least one cross-member to form a unit assembly that is adjustable in position on both of the first deformable quadrilaterals supporting the seat.

3. An elevator chair according to claim 1, wherein each spacer piece is constituted by a plate carrying the fixing pieces and contributing to constituting the back frame triangle.

4. An elevator chair according to claim 3, wherein each plate carries, via two link axes, an upright constituting the back frame and a triangulation strut connected to the same upright.

5. An elevator chair according to claim 4, wherein the triangulation strut is mounted on the plate by a finger engaged in an open notch having a bend.

6. An elevator chair according to claim 3, wherein each plate has two fixing pieces each presenting:

a through bore in which the corresponding bar of the first quadrilateral is threaded;

a pivot for mounting to the plate, the axis of the pivot being orthogonal to the axis of the bore; and clamping means enabling the fixing pieces to be locked axially on the bars.

7. An elevator chair according to claim 6, wherein each fixing piece is associated with removable means for angularly locking the axis of its pivot.

8. An elevator chair according to claim 3, wherein each plate carried, on an "outer" face relative to a sagittal plane of symmetry of the chair, a fixing piece for co-operation with the top bar of the first quadrilateral, and on an "inner" face, a fixing piece for co-operation with the bottom bar, said fixing piece being secured by a cross-member to the corresponding fixing piece of the second assembly.

9. An elevator chair according to claim 3, wherein each spacer piece or plate has means for adjusting the relative spacing between the top and bottom bars of each of the first and second deformable quadrilaterals.

10. An elevator chair according to claim 9, wherein the spacing adjustment means comprise abutments which engage in the low position of the seat frame, co-operating with the bottom bars of the deformable quadrilaterals in such a manner as to allow the position of the seat frame to be adjusted.

* * * * *